United States Patent [19]

Hasegawa et al.

[11] Patent Number: 4,780,011

[45] Date of Patent: Oct. 25, 1988

[54] RIBBON CARTRIDGE

[75] Inventors: Yuzo Hasegawa; Naokazu Shimoda, both of Nagoya, Japan

[73] Assignee: Brother Kogyo Kabushiki Kaisha, Nagoya, Japan

[21] Appl. No.: 546,422

[22] Filed: Oct. 28, 1983

[30] Foreign Application Priority Data

Nov. 20, 1982 [JP] Japan ..... 57-175695[U]

[51] Int. Cl.[4] ..... B65H 75/00

[52] U.S. Cl. ..... 400/242; 400/208; 400/234

[58] Field of Search ..... 400/207, 208, 208.1, 400/234, 242

[56] References Cited

U.S. PATENT DOCUMENTS

| | | | |
|---|---|---|---|
| 4,252,450 | 2/1981 | Goodman et al. | 400/208 |
| 4,317,636 | 3/1982 | Hume | 400/208 |
| 4,367,052 | 1/1983 | Steger | 400/208 |
| 4,397,575 | 8/1983 | Aldrich | 400/208 |

FOREIGN PATENT DOCUMENTS 3045461 6/1982 Fed. Rep. of Germany ..... 400/208

OTHER PUBLICATIONS

Craft, "Compressible Ribbon Roller for Constant Tension", IBM Tech. Disc. Bulletin, vol. 23, No. 10, pp. 4553–4554, 3/81.

French et al., "Anti-Coring Fix for Sandpiper Ribbon, IBM Tech. Disc. Bulletin, vol. 24, No. 8, p. 4098, 1/82.

*Primary Examiner*—David Wiecking

*Assistant Examiner*—James R. McDaniel

*Attorney, Agent, or Firm*—Moonray Kojima

[57] ABSTRACT

A ribbon cartridge having a torsion spring having an improved noval contacting end for pressing the takeup spool against the drive roller, wherein the improved end holds the takeup reel against the roller in a substantially vertical position without any tilting of the takeup reel.

3 Claims, 2 Drawing Sheets

RIBBON CARTRIDGE

BACKGROUND OF THE INVENTION

1. Field of the Invention

This invention relates to ribbon cartridges, such as used in typewriters and printers and the like, and more particularly to improvements in such cartridges.

2. Discussion of Prior Art

Most known ribbon cartridges, used in typewriters, printers and the like, comprise a supply spool for holding a supply of ribbon, a take up spool for winding ribbon after use, both contained in a case. The takeup spool is rotated according to printing operation by a driving roller to wind the ribbon about the takeup spool and off the supply spool, at a fixed winding rate.

As illustrated, for example, in FIG. 1A, which depicts a known ribbon cartridge, a takeup spool 1 is rotated to wind up a ribbon 5, by a drive roller 4 having a plurality of teeth 2 along the circumference thereof. The drive roller is connected to a drive shaft of a motor, not shown, or the like. One end of torsion spring 7 engages stud 6, projecting from the center of an upper surface of the takeup spool 1, to bias the takeup spool 1 continually in the direction of arrow A, as indicated in FIG. 1A, so that takeup spool 1 is rotated by drive roller 4. This construction, however, is disadvantageous, in that, the resilient force of torsion spring 7 tends to tilt the takeup spool 1 in the direction of arrow B, as indicated in FIG. 1B. Torsion spring 7, as can be appreciated, applies biasing force to stud 6, which extends upward from the upper surface of spool 1. Thus, the spool 1 is caused to be tilted by the biasing force of the spring 7 acting on stud 6. This tilted position of spool 1 causes tape 5 to move away from a substantially vertical position after printing and be disaligned while being wound on spool 1. Spool 1 of the prior art devices, cannot wind ribbon 5 in a regular aligned manner and proper ribbon winding is never attained. The disalignment can cause entanglement, and interruption of regularity of printing. Speed is not completely reliable.

Thus, there exists in the art, a need for a ribbon cartridge which can reliably, properly and accurately wind up ribbon, without such ribbon cartridge being increased in price.

SUMMARY OF THE INVENTION

Accordingly, an object of the invention is to overcome the aforementioned and other disadvantages and deficiencies of the prior art.

Another object is to improve ribbon cartridges by providing a mechanism which is capable of biasing the takeup spool, whereby the winding of the takeup spool will be substantially normal to the driving force applied thereto.

A further object is to provide a ribbon cartridge wherein the takeup spool is not tilted during the winding operation.

The foregoing and other objections are attained by this invention which encompasses a ribbon cartridge comprising a supply spool for holding a supply of ribbon, a takeup spool for winding up the ribbon after printing, a drive roller having a plurality of teeth along the circumference thereof to drive the takeup spool, wherein the takeup spool has a recess formed in a central part thereof with a stud provided at the center of the recess, a spring to bias the takeup spool toward the drive roller so that the outermost winding of the wound up ribbon is pressed against the teeth of the drive roller, and wherein the spring is designed to have one end thereof in a bent portion which fits in the recess and is resiliently biased against the stud at a position about midpoint of the width of the ribbon, so that the spring will normally bias the takeup spool against the teeth of the drive roller with the drive roller and the takeup spool having their axis substantially parallel at all times. The bent portion of the spring thus substantially holds the takeup spool in the same position both horizontally and vertically. Advantageously, no tilting of the takeup spool occurs during takeup operation.

DETAILED DESCRIPTION OF PREFERRED EMBODIMENTS

Figure 1A:
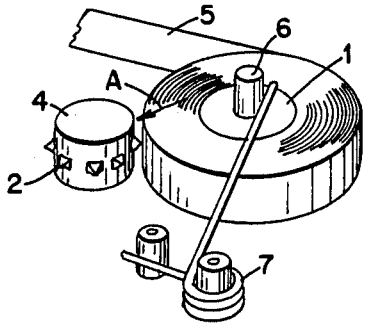
Fig.1A (PRIOR ART)
FIG. 1A is a perspective view depicting a prior art ribbon cartridge.
Figure 1B:
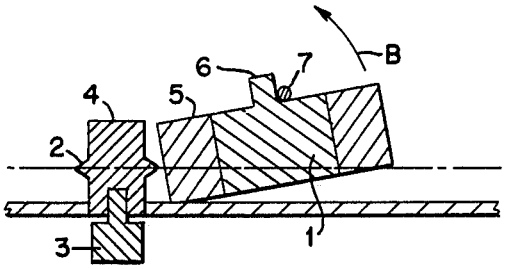
Fig.1B (PRIOR ART)
FIG. 1B is a sectional view depicting a tilted condition of the takeup spool of the prior art cartridge.
Figure 2:
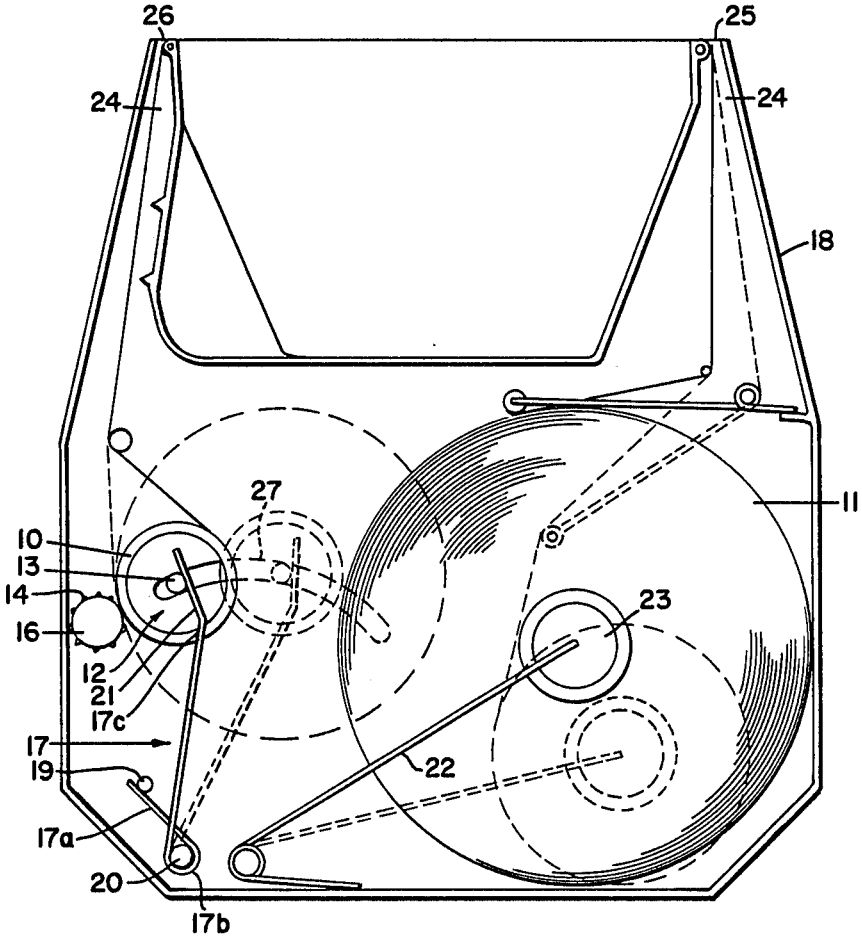
FIG. 2 is a plan view depicting an illustrative embodiment.
Figure 3A:
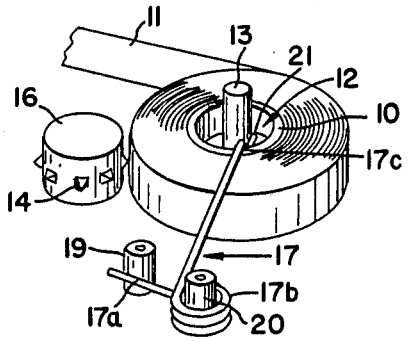
FIG. 3A is a perspective view depicting a mode of driving the takeup spool.
Figure 3B:
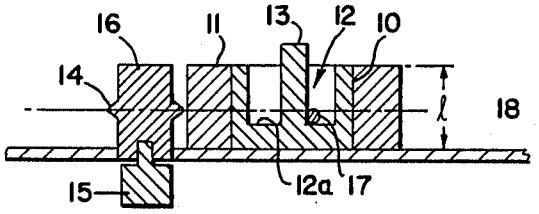
FIG. 3B is a sectional side view depicting the takeup spool without any tilting.

Referring now to FIG. 2, which shows the inside of a ribbon cartridge with an upper case removed for sake of clarity of description, and to FIGS. 3A and 3B, there are depicted a recess 12 in takeup spool 10, of a depth which is slightly greater than one-half of the width l of ribbon 11. A stud 13 is formed upright at the center of recess 12 from bottom surface **12*a*. A drive roller 16 is provided, along the circumference thereof, with a plurality of teeth 14, arranged in a plane, and connected to drive shaft 15 of a motor, not shown. The drive roller rotates and the teeth thereof contact the outermost ribbon on takeup spool 10, to thereby rotate takeup spool 10**.

The takeup spool 10 is biased continuously in a counterclockwise direction as viewed in FIG. 2, namely, toward the drive roller 16, by a torsion spring 17. One end **17*a* of torsion spring 17 engages a stud 19 fixed upright to a bottom case 18 (The top part of the case is omitted for clarity of description). A coiled part 17*b* of torsion spring 17 is pivotally supported on a pin 20, attached to case 18, and a bent portion 21 is formed at the other end 17*c* of torsion spring 17. As can be seen more clearly in FIGS. 3A and 3B, the bend is formed to be lower than the central part of spring 17 and formed to fit in recess 12 and disposed against stud 13. Bend 21 is preferably placed contiguously with the bottom surface 12*a* of recess 12 and resiliently engages stud 13 as shown in FIG. 13B. Thus, the resilience of torsion spring 17 acts on spool 10 so that spool 10 is pressed against the teeth 14 of drive roller 16. As ribbon 11 is wound on spool 10, teeth 14 press against ribbon 11 and drive the spool 10 as depicted in FIG. 3B Since bent portion 21 of torsion spring 17 engages stud 13 within a plane which includes teeth 14 (see FIG. 3B), the resilient force of torsion spring 17 acts as a pressure to press takeup spool 10 against drive roller 16. Thus, spool 10 will not be tilted. Furthermore, since bent portion 21 is lightly in contact with bottom surface 12*a* of recess 12, torsion spring 17 functions also to keep the takeup spool 10** at an appropriate vertical position.

To put this another way, the torsion spring having the novel bend portion configuration acts to keep spool 10 properly aligned vertically and horizontally by suitable pressure on stud 13 and bottom surface 12*a*. In this manner, ribbon 11 is kept substantially vertical (in its width direction) at all times while the take up spool 10 is winding the ribbon. Accordingly, ribbon 11 will be properly wound about takeup spool 10 without disalignment or entanglements, and speed can be reliably maintained.

In printing operation, drive roller 16 drives, by shaft 15 acting thereon, and rotates takeup spool 10. Thus, ribbon 11 wound on supply spool 23 (See FIG. 2) is spooled out from supply spool 23 and wound through ribbon inlet 25 and ribbon outlet 26 formed in the extremities of arms 24, respectively which is disposed on case 18, and onto takeup spool 10. Supply spool 23 is biased continually in a clockwise direction (as viewed in FIG. 2) by a torsion spring 22, pivotally engaging the center hole of supply spool 23.

As printing operation is carried on, the diameter of the wound up ribbon 11 on supply spool 23 decreases gradually, as illustrated by a broken line in FIG. 2. Concurrently, the diameter of the ribbon 11 being wound on takeup spool 10 increases gradually. With the increase in diameter of the wound up ribbon 11, takeup spool 10 moves rightward (as viewed in FIG. 2) with stud 13 being guided by a guide slot 27 formed in the upper case which is not shown.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A ribbon cartridge comprising a case;

a supply spool contained within said case for carrying a supply of ribbon;

a takeup spool contained within said case for winding said ribbon spooled out from said supply spool;

a drive roller for driving said takeup spool, said drive roller comprising a plurality of teeth disposed on the periphery thereof, said teeth being engageable with said ribbon wound on said takeup spool;

a spring means for biasing said takeup spool toward said drive roller;

said takeup spool comprising a circular recess formed in a central axial part thereof and a vertical stud formed in a central axial part of said recess, said recess having a depth greater than one half of said ribbon on said takeup spool; and said spring means comprising one end portion engaged with said case and a bent portion toward another end thereof, said bent portion being disposed within said recess and contiguously with a bottom surface of said recess and engaged with said stud at a position substantially at at least the middle of the width of said wound up ribbon, to cause said spring means to exert a force aganist said stud and against said bottom of said recess to hold said takeup spool in a substantially constant vertical position and to cause said takeup spool to move substantially horizontally without an substantial tilting during winding operation.

2. The cartridge of claim 1, wherein said plurality of teeth of said drive roller are arranged along said circumference of said drive roller in a plane, so as to engage said ribbon wound on said takeup spool, at substantially the middle point of the width of said ribbon.

3. The cartridge of claim 2, wherein said bent portion engages said stud within said recess in a plane which includes a plurality of said teeth of said drive roller.

* * * * *